US006883258B2

(12) United States Patent
McCabe

(10) Patent No.: US 6,883,258 B2
(45) Date of Patent: Apr. 26, 2005

(54) SPREADER APPARATUS AND METHOD FOR ARTICLES OF LAUNDRY

(75) Inventor: Stanley G. McCabe, Lubbock, TX (US)

(73) Assignee: Finish Tech., Ltd., Morton Grove, IL (US)

( * ) Notice: Subject to any disclaimer, the term of this patent is extended or adjusted under 35 U.S.C. 154(b) by 0 days.

(21) Appl. No.: 10/635,879

(22) Filed: Aug. 6, 2003

(65) Prior Publication Data

US 2005/0028409 A1 Feb. 10, 2005

(51) Int. Cl.[7] ..... D06F 67/04
(52) U.S. Cl. ..... 38/143
(58) Field of Search ..... 38/143; 271/3.15, 271/3.18, 109, 225, 226, 265.01, 314, 82; 198/571, 678.1, 803.3; 414/744.2, 621

(56) References Cited

U.S. PATENT DOCUMENTS

| | | | |
|---|---|---|---|
| 3,092,263 | A | 6/1963 | Beaudry et al. |
| 3,092,271 | A | 6/1963 | Beaudry et al. |
| 3,168,307 | A | 2/1965 | Walton et al. |
| 3,421,756 | A | 1/1969 | Weir |

(Continued)

FOREIGN PATENT DOCUMENTS

| | | |
|---|---|---|
| GB | 2219313 | * 12/1989 |

*Primary Examiner*—Ismael Izaguirre
(74) *Attorney, Agent, or Firm*—Brinks Hofer Gilson & Lione

(57) ABSTRACT

Apparatuses and methods spread a towel from a load of towels. The towels are rectangular, such as hand, wash or beach towels. A trailing corner is first identified to isolate one short edge from another short edge. The entire towel is then transported from one side of a center line of a conveyor to another side. Once on the other side, an end of the towel is brought into contact with a moving belt. The moving belt tensions the towel by causing friction downwards or away from the direction the towel is being moved. The clamped corner is moved back to the other side of the center line and released on the conveyor. A pinch belt, such as a pinch belt on one side of the conveyor, conveys one end of the towel in a bunch. The conveyor conveys one portion of the towel while the pinch belt conveys the bunched portion. The conveyor conveys the towel off the end of the conveyor until a trailing corner is detected. A pinch roller is then placed against the conveyor to clamp the trailing corner. The pinch belt conveys the bunch to pinch rollers adjacent to the end of the conveyor. As a result, the towel is suspended by one corner off of the conveyor and an opposite short edge end of the towel is bunched and held in the pinch rollers. The short edge connected with the identified corner wall hangs from the conveyor in an exposed, straight position. A rotatable clamp grabs the edge at several locations. The towel is then suspended from the short edge and provided to one of various other processes, such as automated folding.

30 Claims, 2 Drawing Sheets

U.S. PATENT DOCUMENTS

| | | | | | |
|---|---|---|---|---|---|
| 3,429,063 | A | | 2/1969 | Myers | |
| 3,553,863 | A | | 1/1971 | Sjostrom | |
| 3,696,942 | A | | 10/1972 | Kitchener et al. | |
| 3,911,604 | A | | 10/1975 | Sjostrom | |
| 4,053,967 | A | | 10/1977 | Mair | |
| 4,106,227 | A | | 8/1978 | Allen et al. | |
| 4,299,521 | A | | 11/1981 | Jensen | |
| RE31,453 | E | | 12/1983 | Olsen et al. | |
| 4,501,529 | A | * | 2/1985 | Wiebesiek | 38/143 |
| 4,774,505 | A | | 9/1988 | Ueda et al. | |
| 4,943,198 | A | | 7/1990 | McCabe | |
| 4,979,868 | A | | 12/1990 | Ueda et al. | |
| 5,168,645 | A | | 12/1992 | Robin et al. | |
| 5,169,282 | A | | 12/1992 | Ueda et al. | |
| 5,172,502 | A | | 12/1992 | Kober | |
| 5,300,007 | A | | 4/1994 | Kober | |
| 5,333,402 | A | | 8/1994 | Weir | |
| 5,416,992 | A | | 5/1995 | Ueda et al. | |
| 5,430,915 | A | * | 7/1995 | Ueda et al. | 26/51 |
| 5,440,810 | A | | 8/1995 | Borucki et al. | |
| 5,515,627 | A | | 5/1996 | McCabe | |
| 5,546,684 | A | * | 8/1996 | Jensen | 38/143 |
| 5,595,467 | A | | 1/1997 | Jensen | |
| 5,611,159 | A | * | 3/1997 | Jensen | 38/143 |
| 6,141,893 | A | | 11/2000 | McCabe | |
| 6,477,797 | B1 | | 11/2002 | Takahashi et al. | |
| 6,584,711 | B1 | | 7/2003 | Nakamura | |

* cited by examiner

SPREADER APPARATUS AND METHOD FOR ARTICLES OF LAUNDRY

BACKGROUND

The present invention relates to automated laundry spreaders. In particular, a spreader for laying towels out flat is provided.

Many processes in laundries are automated. For example, machines in hotels spread out, iron, and fold sheets without operator intervention. To begin the automated process, the operator identifies either corners or an edge of the sheet and places the corners or edge into the first machine. Since sheets have large dimensions with thin fabric, the sheets are often tangled together, necessitating either an automated separator machine or an operator for locating the edges or corners.

Since towels are smaller and thicker, towels may be less likely tangled after removal from a washing or drying machine. However, in typical towel processing an operator still grabs individual towels and places them on folding machines. Where possible, automated processes may save money over time.

Machines for automatically grabbing towels from a load of towels and spreading the towels have been attempted, but find little commercial success. Typically, these machines attempt to isolate diagonal corners and then opposite corners. Such isolation can be difficult and inconsistent when implemented with a machine.

BRIEF SUMMARY

The present invention is defined by the following claims, and nothing in this section should be taken as a limitation on those claims. By way of introduction, the preferred embodiments described below include apparatuses and methods for spreading a towel from a load of towels. The towels are rectangular, such as hand, wash or beach towels. A trailing corner is first identified to isolate one short edge from another short edge. The entire towel is then transported from one side of a center line of a conveyor to another side. Once on the other side, an end of the towel is brought into contact with a moving belt. The moving belt tensions the towel by causing friction downwards or away from the direction the towel is being moved. The clamped corner is moved back to the other side of the center line and released on the conveyor. A pinch belt, such as a pinch belt on one side of the conveyor, conveys one end of the towel in a bunch. The conveyor conveys one portion of the towel while the pinch belt conveys the bunched portion. The conveyor conveys the towel off the end of the conveyor until a trailing corner is detected. A pinch roller is then placed against the conveyor to clamp the trailing corner. The pinch belt conveys the bunch to pinch rollers adjacent to the end of the conveyor. As a result, the towel is suspended by one corner off of the conveyor and an opposite short edge end of the towel is bunched and held in the pinch rollers. The short edge connected with the identified corner hangs from the conveyor in an exposed, straight position. A rotatable clamp grabs the edge at several locations. The towel is then suspended from the short edge and provided to one of various other processes, such as automated folding. Each of the individual stages described above may be used in different apparatuses. Each individual stage is used with or without other stages described above. Any of the overall structure, individual stages or combinations of individual stages and associated methods of the embodiments discussed below may provide advantages and be claimed independently herein.

In a first aspect, an apparatus for spreading a towel from a load of towels is provided. Two movable clamps are operable to clamp a towel while positioned on a first side of the center line of a conveyor. Both of the movable clamps are also operable to move to a second or opposite side of the center line of the conveyor while clamping the towel.

In a second aspect, a method for spreading a towel from a load of towels is provided. A towel is clamped at a first location. The towel is clamped near a corner in addition to the first location. Both the first location and the corner are displaced in a substantially same direction while being held. The first location is then released. The corner is then displaced in an opposite direction.

In a third aspect, an apparatus for spreading a towel from a load of towels is provided. A conveyor is operable to convey the towel. A jaw is adjacent the end of the conveyor. A sensor is also adjacent to the conveyor to detect a trailing corner of the towel on the conveyor. The jaw is operable to respond to the sensor detection of the trailing corner and is operable to press against the towel on the conveyor adjacent the trailing corner.

In a fourth aspect, a method for spreading a towel from a load of towels is provided. The towel is conveyed along a surface and off the end of the end of the surface. A trailing corner of the towel is sensed on the surface. The trailing corner is pinched against the surface adjacent to the end of the surface in response to sensing the trailing corner.

In a fifth aspect, an apparatus for spreading a towel from a load of towels is provided. A clamp is operable to clamp a first corner of a towel. Another clamp is positioned away from the first clamp and is operable to clamp a bunch of the towel. The bunch is spaced from the first corner. Another clamp is operable to clamp an edge of the towel connected with the first corner while the towel is suspended from the first corner and the bunch.

In a sixth aspect, a method for spreading a towel from a load of towels is provided. A corner is clamped, and a bunch of the towel is clamped. The bunch is spaced from the first corner. An edge of the towel connected with the first corner is clamped while the towel is suspended from the first corner and the bunch.

Further aspects and advantages of the invention are discussed below in conjunction with the preferred embodiments.

BRIEF DESCRIPTION OF SEVERAL VIEWS OF THE DRAWINGS

The components of the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

FIGS. 1–4 show various aspects of one embodiment. Various stages and aspects of the embodiment may be altered or changed based on now known or later developed devices or methods. The towel spreader isolates the towel from a load of towels and spreads the towel out flat for subsequent processing. For example, the towel is output to an automated towel folder, such as disclosed in U.S. Pat. No. 5,300,007, the disclosure of which is incorporated herein by reference. Alternatively, the spread towel is output to an operator or stacked for further use.

The towel spreader described herein is adapted for isolating and spreading rectangular towels. For example, terry cloth hand, wash or beach towels with short sizes ranging from 6 to 40 inches and long size ranging from 18 to 90 inches are processed. Larger or smaller articles of laundry may also be processed. In other embodiments, one or more of the stages described herein are used for processing square towels, such as face towels. Towels of thinner material, such as woven or knit pillow cases, pillow shams, or other laundry articles, may also be processed. Other articles of laundry, such as sheets or blankets, may also be spread using one, more or all of the stages described herein.

Figure 1:
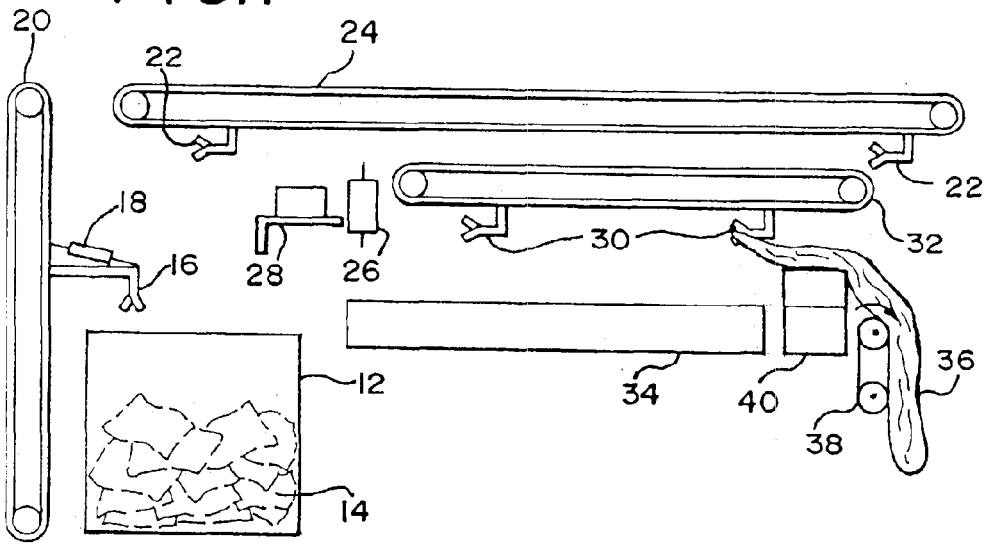
FIG. 1 is a front view of a cutaway portion of one embodiment of a towel spreader.
Figure 2:
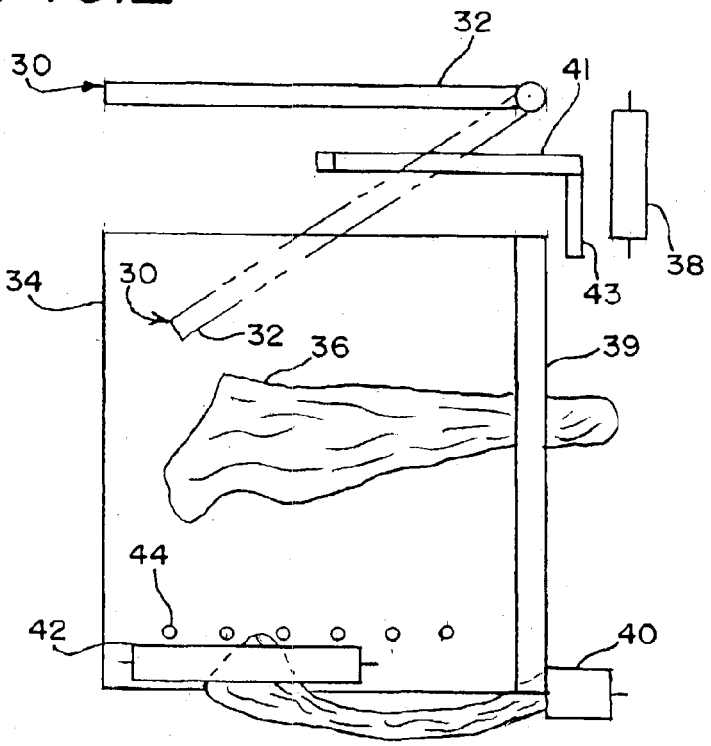
FIG. 2 is a top view of some of the components of FIG. 1.
Figure 3:
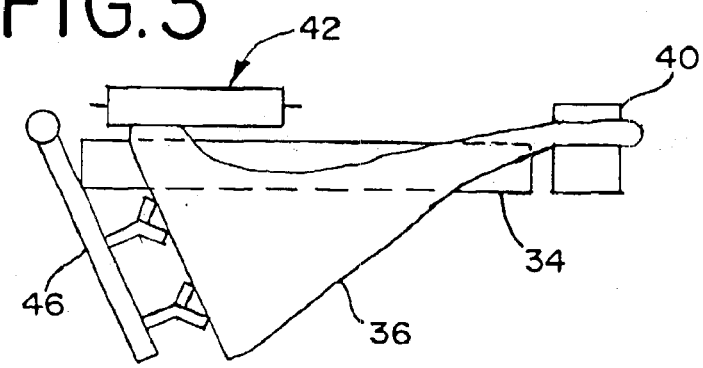
FIG. 3 is a front view of some of the components shown in FIG. 2.
Figure 4:
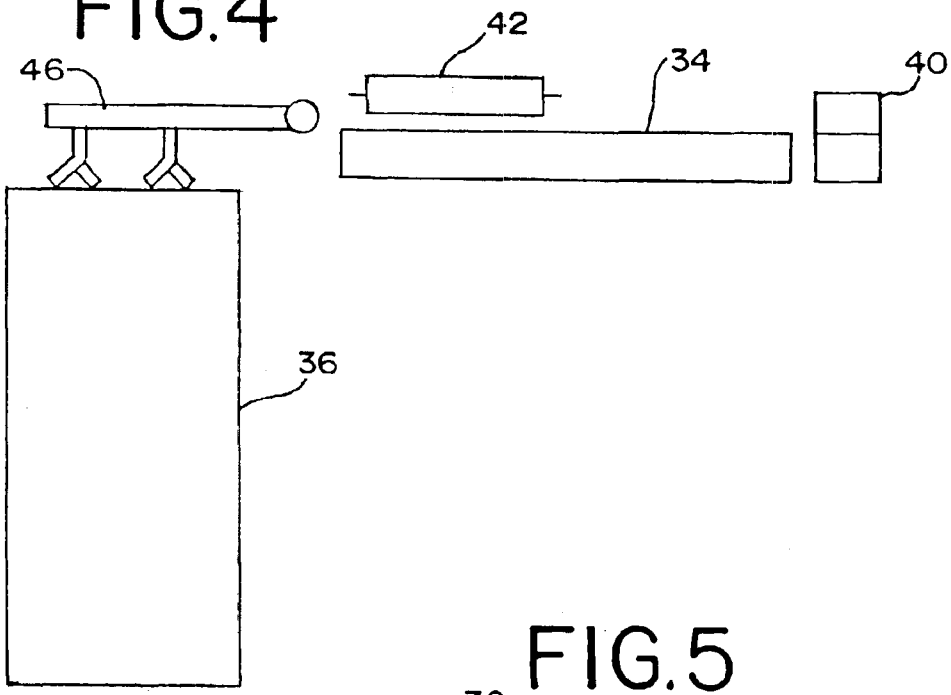
FIG. 4 is a front view of the components of FIG. 3 with the towel hanging for further processing.

FIGS. 1–4 show one apparatus positioned within a single frame structure. Different portions of the apparatus are shown in different views to illustrate the components in operation of various stages for spreading a towel. In one embodiment, the stages are built together within the frame work in as small a space as possible while providing sufficient volume for spreading the towel. FIG. 1 shows a front cutaway view of the beginning processes. FIG. 2 shows a top view including some of the beginning as well as some of the finishing processes and components. FIGS. 3 and 4 show some of the final processing and associated components. Various plates for safety and preventing operators from entanglement within the spreader are included, but not shown. Electrical, hydraulic and air pressure cables and hoses interconnect various components for controlling an operating spreading of the towel. These cables and hoses are configured and routed as is known in the art or later developed. One or more controllers also control the actions of various components as is known.

FIG. 1 shows a bin 12 for holding a load of towels 14. The bin 12 is of various sizes, shapes and/or materials. In one embodiment, the bin 12 tapers towards one location at the bin 12. As the towels are removed from the bin 12, remaining towels migrate toward the location for clamping. The bin 12 is positioned beneath the system in general such that any towels dropped throughout processing are placed back within the bin 12. Alternatively, the bin 12 is small enough such that dropped towels from other portions of the system fall into a separate or different compartment. In alternative embodiments, conveyors, vibration mechanisms, tilting mechanisms, or other devices are provided for continually positioning towels near a clamping position.

A movable clamp 16 is a chuck, scissor clamp, two opposing plates, jaws, pinching roller, pinching conveyors, vacuum device or other structures operable to hold a towel. In one embodiment, the clamp 16 includes one jaw with two metal plates separated by a space and an opposing metal jaw operable to move between the two plates. The towel is clamped between the two jaws. Plastic, wood or other materials may be used. The clamp 16 is actuated by a pneumatic cylinder 18, one or both jaws of the clamp 16 connect with the pneumatic cylinder 18. In alternative embodiments, an electric servo, an air driven cylinder, a hydraulic cylinder, a motor, a valve or other mechanisms are provided for actuating the clamp 16.

The clamp 16 and the actuator 18 are connected to a drive structure 20. In one embodiment, the drive structure 20 is a pulley and motor with an endless belt or chain. For example, a timing belt with an inverter is used. Other structures may be used, such as pneumatic or hydraulic rodless cylinders. The clamp 16 and actuator 18 connect with the endless chain, such as using bolts and plates. Using an electrical control and sensors, the drive structure 20 is operable to position the clamp 16 adjacent to or in the load of towels 14. The clamp 16 clamps one or more towels. The clamp 16 is sized to most likely select a single towel, such as having jaws that extend only about an inch to two inches. The clamped towel and the clamp 16 are moved away from the load of towels 14, such as upwards. Timing on the timing chain of the drive mechanism 20 and/or electric light sensors are used to detect that the towel 22 is positioned at a location for further processing. For example, a light sensor detects the presence of the towel 22 at an upper position or other position ready for clamping by a horizontally movable clamp 22.

The horizontally movable clamp 22 and an associated actuator have the same or different structures as described above for the clamp 16 and the actuator 18. The clamp 22 clamps the towel at a random location. The clamp 22 includes a drive mechanism 24 of the same or different structure as the drive mechanism 20 discussed above. In response to sensing a towel 22 in a proper position, the drive mechanism 24 positions the clamp 22 against the towel. Once positioned against the towel, the clamp 22 closes to grab the towel. In one embodiment, a sensor is provided to detect that the clamp 22 is in a correct position relative to the towel. In other embodiments, the clamp 22 is positioned at a location where a towel should be located. In response to the closing of the clamp 22, the clamp 16 releases the towel. The clamp 22 grabs the towel just below the clamp 16 or another location anywhere on the towel. The drive mechanism 24 moves the clamp 22 and the towel horizontally away from the clamp 16. Movement up or down or in any other direction may be provided. The towel hangs by force of gravity from the clamp 22 until coming into contact with a plate 28.

The plate 28 is a metal, plastic or other material flat or irregular plate. In one embodiment, the plate 28 is flat, but curved or other surfaces may be used. The plate 28 includes one or more guides for guiding the towel along the plate 28 as clamp 22 moves horizontally. The plate 28 guides the towel through pinch rollers 26 as the clamp 22 moves the towel away from the clamp 16. The pinch rollers 26 are positioned in a vertical orientation so that the plate 28 prevents downward movement of the towel and the pinch rollers 26 maintain a horizontal position of the towel. The pinch rollers 26 are driven at about a same speed as the movement of the clamp 22 and towel. In one embodiment, both rollers 26 are driven, but one or none of the rollers 26 are driven in other embodiments. In response to sensing a trailing portion, such as a corner portion of the towel along the plate 28, the pinch rollers 26 is activated to clamp the towel or prevent movement of the towel. For example, a brake clutch is activated for one or both of the rollers 26. In alternative embodiments, a scissor clamp, a roller positioned against the plate 28 or other form of clamp than the pinch rollers 26 is used to clamp the trailing corner. The pinch rollers 26 isolates the trailing corner of the towel on the plate 28.

Another horizontally movable clamp 30 is positioned adjacent to the pinch roller 26. The clamp 30 is of the same or different structure as discussed above for the clamp 16 and actuator 18, such as a pair of jaws and an activator. The clamp 30 is moved by a movement mechanism 32 with the same or different structure as discussed above for movement mechanism 20. The movement mechanism 32 in one embodiment is a pneumatic rodless cylinder pivotably connected on one end as represented by the solid and dashed line positions shown in FIG. 2. The clamp 30 is positioned adjacent to the pinch rollers 26 to clamp at or near the trailing corner. In one embodiment, the clamp 30 rotatably connects to the movement mechanism 32 with an actuator for rotating the clamp 30 down onto the towel held by the pinch rollers 26. The movement mechanism 32 positions the clamp laterally next to the pinch rollers 26 so that the clamp 30 rotates to grab the towel near the trailing corner pinched between the pinch rollers 26. In alternative embodiments, the clamp 30 is fixedly mounted to the movement mechanism 32 and is moved laterally to clamp the towel. Once the clamp 30 clamps the towel, the pinch rollers 26 releases the towel, such as by allowing rotation of the rollers 26 or moving the rollers 26 apart.

FIG. 1 shows the clamp 22 and the clamp 30 in two different positions. The two different positions are shown on different sides of a center line of a conveyor 34. The center line extends along a direction of travel of the conveyor 34. In one embodiment, a single clamp 22 and a single clamp 30 are provided, but multiple clamps 22 and clamps 30 may be provided or a same run or belt in alternative embodiments.

The conveyor 34 includes at least two rollers with one or more belts extending between each roller, such as a plurality of straps of fabric, rubber, or other material. The conveyor 34 includes a platform beneath the straps in between the rollers in one embodiment, but embodiments may be provided without a platform. The conveyor 34 is positioned below and in front of the clamps 22 and 30. The conveyor is wide enough to hold a majority of the towel along the lengthwise dimension. The length of the conveyor 34 along with direction of travel is from about 6 inches to 2 feet, but shorter or longer lengths may be provided. The conveyor 34 is operable to convey the towel away from the clamps 22 and 30. As shown in FIG. 2, the conveyor 34 is operable to convey a towel 36 off of an end of the conveyor 34. The towel is conveyed along an upper surface of the conveyor 34 and off the end of that surface.

Both clamps 22 and 30 are operable to move from one side of the center line, such as a first side where the towel is first clamped, to a different side of the center line, such as an opposite side as shown in FIG. 1. After clamping the towel, the clamps 22 and 30 move from one side of the center line of the conveyor 34 to another side while maintaining the clamp on the towel 36. As shown in FIG. 1, the clamp 22 and clamp 30 move in a substantially same direction. Substantially is used herein to account for movement at slightly different angles, such as associated with stretching out the towel. The clamp 22 releases the towel 36, such as releasing at an end position of the movement mechanism 24. The clamp 30 holding the corner or adjacent to the corner of the towel maintains the hold on the towel 36. After the clamp 22 releases the towel, the clamp 30 is moved in an opposite direction or back towards the pinch roller 26. The pivotally attached movement mechanism 32 for the clamp 30 is rotated so that the clamp 30 moves towards a position over the conveyor 34 as shown by the dashed lines in FIG. 2. As a result, the corner of the towel is displaced in an opposite direction back to the other side of the center line of the conveyor 34.

When the clamp 22 releases the towel, the towel falls. As the clamp 30 moves back towards the other side of the center line, the towel 36 is positioned in contact with a belt 38. The belt 38 is around one or more rollers and has a same or different structure as the conveyor 34 discussed above. A single strap is provided for the belt 38, but multiple belts or conveyors may be used. In one embodiment, the belt 38 is positioned to conveyor an outer portion of the belt 38 downwards as shown in FIG. 1. When the towel 36 comes in contact with the belt 38, the belt 38 acts to pull down on the towel 36 and in a different, such as opposite direction, than the movement of the clamp 36 to the other side of the conveyor 34. Since the belt 38 is below the release point of the clamp 32, the towel 36 falls in contact with the belt 38. By angling the rollers of the belt 38 in a substantially a horizontal position, maximum movement or friction by the belt 38 on the towel 36 is provided to stretch out and remove any folds or wrinkles. The belt 38 acts to straighten and tension the towel. The clamp 30 continues movement, dragging the towel over the belt 38.

As shown in FIG. 2, the clamp 30 extends back across the center line of the conveyor 34 to position the corner of the towel and the clamp 30 over the conveyor 34. The portion of the towel 36 adjacent to the corner held by clamp 30 hangs down in front of the conveyor 34 as the clamp is positioned over the conveyor 34. Once the clamp 30 is positioned over the conveyor 34, the clamp 30 releases the corner onto the conveyor. In alternative embodiments, an air blast, additional clamps, a moving plate or other devices are used for transferring the towel 36 from the clamp 30 onto the top surface of the conveyor 34.

Since the clamp 30 releases the corner over the conveyor 34 with the adjacent corner along a short edge hanging down in front of the conveyor, one corner (i.e., the adjacent corner to the corner held and released by the clamp 30) hangs vertically off the front or beginning of the conveyor 34 and is conveyed up onto the conveyor 34. Alternatively, the corner held by the clamp 30 is dropped in front of the conveyor and the hanging down portion is moved by air or mechanically onto the conveyor 34 while the conveyor 34 is moving so that the corner is a trailing corner.

A pinch belt or pinch conveyor 39 is positioned adjacent to the conveyor 34, such as positioned on top of the conveyor 39 along a side of the conveyor 34. The pinch belt 39 includes at least one endless belts positioned either in contact or with sufficiently narrow spacing with the conveyor 34 to grip the towel 36. The pinch belt 39 include two or more rollers stretching the belt tight so as to maintain constant contact with the towel 36 between the belt 39 and the conveyor 34. Additional rollers may be provided and/or a separate conveyor than conveyor 34 may be used. The rollers are of metallic, plastic or rubber material. One or more of the rollers are connected to allow vertical flexing, such as providing a spring disposing the rollers and belt against the conveyor 34 but allowing separation of the belt 39 from the conveyor 34 as a towel 36 passes along the conveyor 34. The pinch belt 39 is driven or allowed to move based on the driven movement of the conveyor 34. The pinch belts 40 are driven in a substantially same direction as the conveyor 34. Substantially is used to account for manufacturing tolerances, any divergence for stretching of the towel or dragging the towel to a different position on the conveyor 34. In alternative embodiments, an additional clamp, pinch roller, or other structure for holding and conveying the towel 36 in a substantially same direction as the conveyor 34 is provided.

Figure 5:
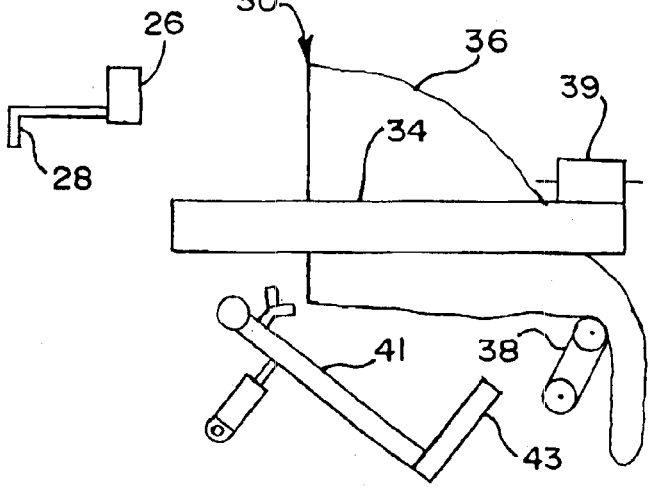
FIG. 5 is a front view of components for transferring the towel from a clamp to a conveyor.

As shown in FIGS. 2 and 5, a rotatable arm 41 with an actuator is positioned below the towel 36 in front of the conveyor 34. The rotatable arm 41 is a flat plate of metal, plastic or other material, but other shapes may be used. The rotatable arm 41 is positioned to lift the towel 36 off of the belt 38 while or after the clamp 30 moves to a position above the conveyor 34. The rotatable arm 41 continues to lift the towel 36 to a position in front of the conveyor 34 near the pinch belt 39. An extendable arm 43 is connected to an end of the rotatable arm 41. In one embodiment, the extendable arm 43 is a plastic piece with a rodless air cylinder, but other materials and structures may be used. As the towel 36 is lifted, the extendable arm 43 is positioned in contact with the towel 36. Once the rotatable arm 41 positions the towel in front of the conveyor 34 and pinch belt 39, the extendable arm 43 is extended. The extension pushes a bunch of the towel 36 between the pinch belt 39 and the conveyor 34. Since the pinch belt 39 allows clamping contact in more than one location of the towel, the bunch of the towel 36 is clamped between the pinch belt 39 and conveyor 34. For example, an entire width of the towel 36 near one short edge of the towel 36 is clamped by the pinch belt 39. The bunch is spaced from the corner and the clamp 30 associated with the opposite short edge of the towel 36. As a result, the bunch is conveyed by the pinch belt 39 while the trailing corner of the towel 36 and remainder of the towel are conveyed by the conveyor 34. Thus, a portion of the towel 36, such as the bunched portion, is conveyed on one side of the surface of the conveyor 34 by the pinch belt 39 and/or the conveyor 34, but travels in a same or substantially same direction.

As shown in FIGS. 2–4, a jaw 42 is positioned adjacent to the end of the conveyor 34. The jaw 42 comprises a portion of a clamp, a pinch roller, a plate, a bar, a device with a plurality of points or teeth, or any now known or later developed jaw for clamping. A sensor 44 is also positioned adjacent to the conveyor 34. The sensor 44 is a light sensor, motion sensor or other now known or later developed device for detecting the presence or absence of the towel 36. In one embodiment, the sensor 44 is positioned within the conveyor 34 such as between straps so as to detect a towel traveling over the sensor 44. In alternative embodiments, the sensor 44 is positioned above, to the side, in front or behind the conveyor 34. As shown in FIG. 2, the sensor is an array of devices so that the trailing corner is detected along any of various portions of the conveyor 34.

The pinch belt 39 and/or conveyor 34 conveys the bunched portion of the towel to a pair of pinch rollers 40. In alternative embodiments, the pinch belt 39 is used without the pinch rollers 40 or other clamping structures are provided to hold the bunch at the end of the conveyor 34. The pinch rollers 40 are positioned adjacent to the pinch belt 39 and the conveyor 34. A portion of the towel extending off of the conveyor 34 from under the pinch belt 39 is positioned between the pinch rollers 40. One or both of the pinch rollers 40 are driven to clamp and move part of the bunch forward or in a same direction as the conveyor 34. The rest of the bunch is maintained between the pinch rollers 40, such as by using a sensor to detect the position of the bunch of the towel 36 relative to the end of the pinch belt 39 or extending beyond or into the pinch rollers 40. A part of the bunch may be released from the end of the pinch rollers 40. The pinch belt 39 continues to run, allowing the towel 36 to be released from under the pinch belt 39. At a same or similar time, the conveyor 34 conveys the towel 36 and the trailing corner. The towel is conveyed off of the end of the conveyor 34 as shown in FIGS. 2 and 3. An area at the end of the conveyor 34 and below the conveyor 34, such as just below the jaw 42, is kept free of obstruction so that the towel hangs down from the conveyor 34.

The jaw 42 is responsive to the sensor 44. When the sensor 44 detects a trailing corner, the jaw 42 is activated to press against the towel 36 and the conveyor 34. Pneumatic, hydraulic, mechanical or electrical power may be provided to move the jaw 42 against the conveyor 34. The jaw 42 pinches the trailing corner of the towel 36 against the surface of the conveyor adjacent to the end of the conveyor 34. In response to the sensors 44 detecting the trailing edge or the jaw 42 pressing against the conveyor 34, the conveyor 34 ceases to convey the towel 36.

The pinch rollers 40 hold a section of the towel spaced away from the trailing corner held by the jaw 42. Since a bunch of the towel is held by the pinch rollers 40 and only a corner is held by the jaw 42, an edge, such as a short edge adjacent to the trailing corner held by the jaw 42, hangs down from the front of the conveyor 34. The edge hangs down at about 180 to 135 degrees where 0 degrees is vertical and 90 degrees is horizontal towards the pinch belt 40.

In alternative embodiments, the pinch rollers 40 feed the bunch from from the pinch rollers 40 until only a trailing edge is held between the pinch rollers 40. As a result, the short edge is likely to be extended vertically from the trailing corner gripped by the jaw 42. The towel is then ready for further processing, but in a long side first position. For example, transfer clamps grab the towel near the corners or edges held by the jaw 42 and the pinch rollers 40. In other embodiments, the transfer clamps grab the towel at a long edge or corners suspended from the conveyor 34. In yet other embodiments, the towel is placed on an exit or feed conveyor. Once the lower edge is square from the pinch rollers 40 feeding out the bunch, the exit or feed conveyor is positioned below or against the towel to convey the towel for further processing.

To allow further processing for the short side first, another clamp 46 rotates to grab the edge of the towel 36. The clamp 46 is a pair of clamps with the same structure as described above for the clamp 16 and actuator 18. Fewer or additional clamping structures may be provided for the clamp 46. The pair of clamps has two sets of jaws positioned on a rotatable arm. The rotatable arm is driven by a servo, electric motor, gearing, belt, chain, pneumatic motor, hydraulic motor or other now know or later developed device. In one embodiment, the rotatable arm comprises a metal beam, but other materials may be used. As an alternative to rotating the clamp, the clamp 46 is translated or extended to the towel 36. One or both sets of jaws on the clamp 46 are connected to the rotatable arm by a rack and pinion, gear, belt, chain or other device for allowing the set of jaws to move along the rotatable arm. Alternatively, both sets of jaws are fixedly attached to the rotatable arm 46. The clamp 46 is positioned adjacent to the end of the conveyor 34. As a result, the clamp 46 rotates to position the sets of jaws adjacent to the short edge hanging from the front of the conveyor 34 by the trailing corner.

One or more sensors, such as a light sensor are used to detect the amount of rotation necessary to place the edge of the towel within the sets of jaws of the clamp 46. Alternatively, the clamps 46 are rotated to a set position likely to place the towel 36 in the sets of jaws of the clamp 46. Where an outermost set of jaws is movable along the rotatable arm, the outermost set of jaws moves outward or inward corresponding to a corner of the towel hanging down below the conveyor 34. The other set of jaws is either fixedly or movably positioned to contact the edge of the towel adjacent to the trailing corner, such a within one to six inches of the trailing corner. Once positioned, the clamp 46 clamps the short edge of the towel 36 in at least two locations.

As shown in FIG. 4, once the clamp 46 grabs the towel 36, the pinch roller of the jaw 42 is lifted away from the conveyor 34 or allowed to rotate or both. The pinch rollers 40 are activated to feed the remainder of the towel from the pinch rollers 40. As a result, the towel 36 hangs from the clamp 46. The clamp 46 rotates to a horizontal position so that the towel hangs without folds in a known orientation. In particular, the short sides of the rectangular towel are held horizontally and the long sides are in a vertical position. The suspended edge and associated towel 36 are then positioned to be fed short side first into a folder, stacker or ironer using an air blast, forward motion of the clamp 46 or another clamp or a conveyor. In yet other alternative embodiments, an additional clamp clamps the long side of the towel 36 and the short side is released by the clamp 46. By isolating a single trailing corner and holding a bunch associated with an opposite short edge of a rectangular towel, a spread towel is obtained.

While the invention has been described above by reference to various embodiments, it should be understood that many changes and modifications can be made without departing from the scope of the invention. For example, any number of additional stages may be provided. Different clamp, conveyor, sensor, actuator or drive structures may be used, including now known or later developed structures. It is therefore intended that the foregoing detailed description be understood as an illustration of the preferred embodiment of the invention and not as a definition of the invention. It is only the following claims, including all equivalents, that are intended to define the scope of the invention.

What is claimed is:

1. An apparatus for spreading an article of laundry from a load of articles of laundry, the apparatus comprising:

a first moveable clamp;

a second moveable clamp;

a conveyor operable to convey the article of laundry away from the first and second clamps, the conveyor having a center line parallel with a direction of conveyance;

wherein the both the first and second moveable clamps are operable to clamp the article of laundry while positioned on a first side of the center line and both the first and second moveable clamps are operable to move to a second side of the center line opposite the first side while clamping the article of laundry.

2. The apparatus of claim 1 wherein the first and second moveable clamps each comprise a pair of jaws, an endless loop connected with a motor and an actuator.

3. The apparatus of claim 1 wherein the first moveable clamp is operable to release the article of laundry on the second side of the centerline and the second moveable clamp is operable to maintain the clamp on the article of laundry while returning to the first side of the center line.

4. The apparatus of claim 1 wherein the first and second moveable clamps are positioned above the conveyor and move horizontally relative to the conveyor.

5. The apparatus of claim 1 wherein the second moveable clamp is operable to release the article of laundry on the first side of the centerline and on top of the conveyor.

6. The apparatus of claim 1 further comprising a pinch roller, the second clamp operable to clamp the article of laundry adjacent to the pinch roller.

7. The apparatus of claim 1 further comprising a belt with a roller positioned on the second side of the centerline below a release point of the first moveable clamp, an axis of the roller angled away from horizontal, wherein the second moveable clamp is operable to drag at least a portion of the article of laundry over the belt as the second moveable clamp returns to the first side of the center line.

8. A method for spreading an article of laundry from a load of articles of laundry, the method comprising:

(a) clamping the article of laundry at a first location;

(b) clamping the article of laundry at one of at and adjacent to a corner in addition to the first location;

(c) displacing both the first location and the corner in a substantially same first direction while the article of laundry is clamped at the first location and the one location in addition to the first location;

(d) releasing the first location; and (e) displacing the corner in a second direction substantially opposite the first direction after (d) while still clamping at the one location in addition to the first location.

9. The method of claim 8 wherein (c) comprises displacing the first location and the corner from a first side of a centerline of a conveyor to a second side of the centerline of the conveyor and (e) comprises displacing the corner back to the first side of the centerline of the conveyor.

10. The method of claim 8 wherein (c) and (e) comprise moving the article of laundry horizontally.

11. The method of claim 8 further comprising:

(f) releasing the corner of the article of laundry on top of a conveyor.

12. The method of claim 8 further comprising:

(f) isolating the corner prior to (b) with a pinch roller.

13. The method of claim 8 further comprising:

(f) dropping a portion of the article of laundry on a belt due to (d); and (g) moving a belt.

14. An apparatus for spreading an article of laundry from a load of articles of laundry, the apparatus comprising:

a conveyor operable to convey the article of laundry;

a jaw adjacent an end of the conveyor; and a sensor adjacent the conveyor, the sensor operable to detect a trailing corner of the article of laundry on the conveyor;

wherein the jaw is responsive the sensor detection of the trailing corner of the article of laundry, the jaw operable to press against the article of laundry on the conveyor adjacent to the trailing corner;

further comprising a pair of clamps positioned on a rotatable arm, the pair of clamps operable to rotate to an edge of the article of laundry suspended from the conveyor.

15. The apparatus of claim 14 wherein an area below the jaw is free of obstruction such that at least part of the article of laundry hangs downward from the conveyor.

16. The apparatus of claim 15 further comprising a pair of pinch belts adjacent the conveyor, the pinch belts running in a substantially same direction as the conveyor, the pinch belts operable to hold a section of the article of laundry spaced away from the trailing corner such that an edge of the article of laundry connected with the trailing corner hangs down about 180 degrees to 135 degrees from the trailing corner where straight up is 0 degrees and horizontal towards the pair of pinch belts is 90 degrees.

17. A method for spreading an article of laundry from a load of articles of laundry, the method comprising:

(a) conveying the article of laundry along a surface of a conveyor and off an end of the surface, the conveying being by the conveyor;

(b) sensing a trailing corner of the article of laundry on the surface;

(c) pinching the trailing corner against the surface adjacent the end of the surface in response to (b);

(d) holding a section of the article of laundry spaced away from the trailing corner; and (e) conveying the section off of the surface and in a substantially same direction as the article of laundry is conveyed on the surface.

18. The method of claim 17 wherein (a) comprises conveying the article of laundry off the end wherein an area below the end is free of obstruction such that at least a part of the article of laundry off of the surface hangs downward from the conveyor.

19. The method of claim 17 wherein (d) comprises holding the section such that, after (c), an edge of the article of laundry connected with the trailing corner hangs down about 180 degrees to 135 degrees from the trailing corner where straight up is 0 degrees when viewed along a center line of a horizontal conveyor counter to a direction of conveyance by the conveyor.

20. The method of claim 17 further comprising:

(f) clamping an edge hanging down from the corner after (c).

21. An apparatus for spreading an article of laundry from a load of articles of laundry, the apparatus comprising:

a first clamp operable to clamp a first corner of the article of laundry;

a second clamp positioned away from the first clamp and operable to clamp a bunch of the article of laundry, the bunch spaced from the first corner; and a third clamp operable to clamp an edge of the article of laundry connected with the first corner while the article of laundry is suspended from the first corner and the bunch when clamped by the first and second clamps.

22. The apparatus of claim 21 wherein the first clamp comprises a conveyor and a pinch roller, the conveyor operable to convey the article of laundry such that the first corner is positioned beneath the pinch roller.

23. The apparatus of claim 21 wherein the second clamp comprises a pair of pinch belts operable to clamp and convey the bunch.

24. The apparatus of claim 21 wherein the third clamp comprises a rotating arm with at least two sets of jaws.

25. A method for spreading an article of laundry from a load of articles of laundry, the apparatus comprising:

(a) clamping a first corner of the article of laundry;

(b) clamping a bunch of the article of laundry, the bunch spaced from the first corner; and (c) clamping an edge of the article of laundry connected with the first corner while the article of laundry is suspended from the first corner and the bunch after (a) and (b).

26. The method of claim 25 wherein (a) comprises:

(a1) conveying the article of laundry on a surface;

(a2) sensing a trailing corner; and (a3) clamping the trailing corner.

27. The method of claim 25 wherein (b) comprises positioning a bunch between a pair of pinch belts;

further comprising:

(d) conveying the bunch between the pinch belts.

28. The method of claim 25 wherein (c) comprises rotating a clamp to the edge, further comprising:

(d) rotating the clamp;

(e) suspending the edge of the article of laundry from the clamp adjacent to a feed input.

29. An apparatus for spreading an article of laundry from a load of articles of laundry, the apparatus comprising:

a first moveable clamp;

a second moveable clamp;

a conveyor operable to convey the article of laundry away from the first and second clamps, the conveyor having a center line parallel with a direction of conveyance;

wherein the both the first and second moveable clamps are operable to clamp the article of laundry while positioned on a first side of the center line and both the first and second moveable clamps are operable to move to a second side of the center line opposite the first side while clamping the article of laundry, the first clamp operable to release the article of laundry on the second side and the second clamp operable to release the article of laundry on the conveyor;

a jaw adjacent an end of the conveyor;

a sensor adjacent the conveyor, the sensor operable to detect a trailing corner of the article of laundry on the conveyor, wherein the jaw is responsive the sensor detection of the trailing corner of the article of laundry, the jaw operable to press against the article of laundry on the conveyor adjacent to the trailing corner;

a third clamp positioned away from the jaw and operable to clamp a bunch of the article of laundry, the bunch spaced from the trailing corner; and a fourth clamp operable to clamp an edge of the article of laundry connected with the trailing corner while the article of laundry is suspended from the trailing corner and the bunch when clamped by the third and fourth clamps.

30. A method for spreading a rectangular article of laundry from a load of articles of laundry, the method comprising:

(a) identifying a first corner on a first short edge of the article of laundry;

(b) holding a bunch, the bunch being adjacent a second short edge, the second short edge opposite the first short edge;

(c) releasing the first corner;

(d) identifying one of the first corner and a second corner on the first short edge after (c); and (e) clamping the first short edge while holding the bunch.

* * * * *